US005987944A

United States Patent [19]

Brekiewicz et al.

[11] Patent Number: 5,987,944

[45] Date of Patent: Nov. 23, 1999

[54] LOCKING DEVICE

[75] Inventors: Reiner Brekiewicz, Wuppertal; Alfred Kasum, Neuss, both of Germany

[73] Assignee: Becker Group Europe GmbH, Wuppertal, Germany

[21] Appl. No.: 08/988,566

[22] Filed: Dec. 11, 1997

[30] Foreign Application Priority Data

Dec. 14, 1996 [DE] Germany ..... 196 52 093

[51] Int. Cl.[6] ..... E05B 65/36

[52] U.S. Cl. ..... 70/264; 70/277; 70/278.6; 70/278.7; 70/282; 292/153; 292/201; 292/254

[58] Field of Search ..... 70/264, 277, 278.6, 70/278.7, 280–283; 292/153, 201, 254

[56] References Cited

U.S. PATENT DOCUMENTS

| | | | |
|---|---|---|---|
| 1,262,435 | 4/1918 | Berg | 292/153 X |
| 1,337,554 | 4/1920 | Harris | 292/153 |
| 2,031,523 | 2/1936 | Braren | 292/153 X |
| 2,299,646 | 10/1942 | Muller | 292/153 X |
| 2,325,225 | 7/1943 | Burke | 292/201 X |
| 3,813,119 | 5/1974 | Panici | 292/201 X |
| 3,915,491 | 10/1975 | Montgomery | 292/201 X |
| 3,919,869 | 11/1975 | Fromm | 70/264 X |
| 4,109,950 | 8/1978 | Amdal | 292/254 |
| 4,288,118 | 9/1981 | Ohkado | 292/201 |
| 4,355,830 | 10/1982 | Rau, III | 292/254 X |
| 4,428,607 | 1/1984 | Levine | 292/201 |
| 4,534,193 | 8/1985 | Takemura et al. | 70/218 |
| 4,540,208 | 9/1985 | Logan, Jr. et al. | 292/201 X |
| 4,896,520 | 1/1990 | Bruhnke et al. | 70/159 |
| 5,755,126 | 5/1998 | Lanigan et al. | 292/201 X |

FOREIGN PATENT DOCUMENTS

| | | | |
|---|---|---|---|
| 524460 | 12/1953 | Belgium | 292/201 |
| 2 448 610 | 9/1980 | France . | |
| 59965 | 12/1891 | Germany | 292/201 |
| 3743282 | 7/1989 | Germany | 70/264 |
| 42 30 242 A1 | 3/1994 | Germany . | |
| 295 02 202 U | 5/1995 | Germany . | |
| 44 07 522 C1 | 6/1995 | Germany . | |
| 44 24 201 A1 | 1/1996 | Germany . | |
| 446613 | 5/1975 | U.S.S.R. | 292/254 |
| 777191 | 11/1980 | U.S.S.R. | 292/201 |
| 989018 | 1/1983 | U.S.S.R. | 292/336.3 |
| 287293 | 3/1928 | United Kingdom | 292/153 |

*Primary Examiner*—Lloyd A. Gall
*Attorney, Agent, or Firm*—Harness, Dickey & Pierce, P.L.C.

[57] ABSTRACT

A locking device for a container lid is provided, in particular for the lid of a storage compartment in a motor vehicle, with a spring-loaded closing cam which is arranged in a projecting manner at the free end of the lid and which, when the lid is closed, engages releasably in a latching recess of a latching recess housing arranged on the storage compartment, with a transducer element which is likewise arranged on the storage compartment and can be triggered via a central locking system with a view to locking and unlocking, and with a reversing linkage, mounted at one end on the transducer element and at the other end on the latching recess housing, for actuating a closing hook which can be pivoted into a latching opening of the closing cam.

8 Claims, 2 Drawing Sheets

LOCKING DEVICE

BACKGROUND OF THE INVENTION

The invention relates to a locking device for a container lid, in particular for the lid of a storage compartment in a motor vehicle.

DE 42 30 242 A1 discloses a storage compartment designed as a central console for a motor vehicle, with a lid designed as an arm rest, the lid being raisable after a locking device has been released. Although the subject of DE 42 30 242 A1 has proved successful per se in practice, it is criticized for lacking protection against unauthorized opening of the lid.

The state of the art also includes, however, storage compartments with a lid which have become known through public use. In most cases, these lids may be locked by means of a cylinder lock which is to be actuated by a key, which, however, is considered to be inconvenient.

OBJECT OF THE INVENTION

The object of the invention is to make available a locking device for a container lid, in particular for the lid of a storage compartment in a motor vehicle. This device would afford effective protection against theft, in other words, effective protection against unauthorized opening of the closed lid.

SUMMARY OF THE INVENTION

In order to achieve this object, in the device, according to the present invention, the lid is provided with a spring-loaded closing cam which is arranged in a projecting manner at the free end of the lid. When the lid is closed, the cam engages releasably in a latching recess of a latching recess housing arranged on the storage compartment. The storage compartment is furthermore provided with a transducer element which is likewise arranged thereon and can be triggered via a central locking system with a view to locking and unlocking. A reversing linkage is provided, which is mounted at one end on the transducer element and at the other end on the latching recess housing, for actuating a closing hook which can be pivoted into a latching opening of the closing cam.

The subject of the invention incorporates a closing and locking device in one. When the central locking system is open, the closing device is active in order to keep the lid in the closed position, with the closing cam being located in the latching recess. On opening of the lid, however, by means of a run-on slope provided on the closing cam, the closing cam can recede against the force of the spring loading it, so that the lid can be opened completely after a low retaining force has been overcome. When the central locking system is closed, however, the closing cam is blocked by the closing hook engaging therein so that true locking of the lid is brought about. Such locking is especially advantageous in particular in the case of cabriolets (i.e. convertibles), above all when the vehicle is parked with the roof down. A further advantage of the invention consists in that the locking is not visible from outside.

According to an improvement of the invention, the closing hook can be unlocked against the force of a restoring spring. A lid can thus still be closed even when the central locking system is in the closed position.

A further embodiment of the invention makes provision for the closing hook to be connected positively to the reversing linkage in the unlocking direction. As a result, when the central locking system is open, the closing hook is kept constantly in the open position against the force of the opening spring. The reversing linkage expediently comprises an angle lever and a transmission lever, with the angle lever being pivotable about a pin fixed to the storage compartment. The angle lever is mounted at one end on a pivot pin belonging to the transducer element and at the other end on a driver pin, to which the transmission lever is also connected by a bearing bore made in the form of a slot, the other end region of which lever is received pivotably by a pin, which also bears the closing hook, on the latching recess housing. An exemplary embodiment of the invention will be described in greater detail below with reference to the drawings.

DETAILED DESCRIPTION OF THE PREFERRED EMBODIMENT

Figure 2:
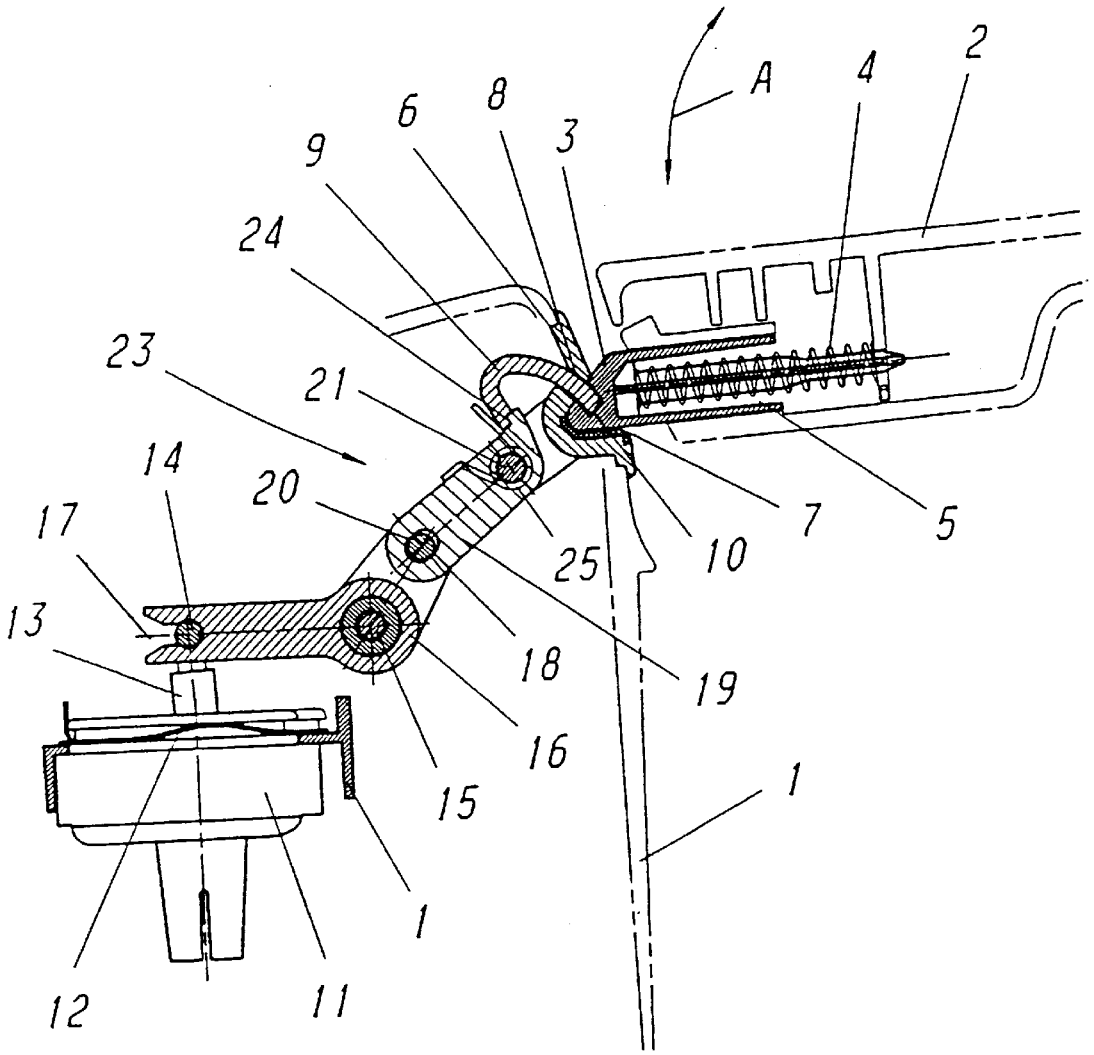
FIG. 2 shows a cross-sectional view of an installation situation of the locking device according to FIG. 1.

Referring now to FIG. 2, on a storage compartment 1, which is for example designed in a central console of a vehicle, a lid 2 is conventionally articulated and pivotable in the direction of the double arrow A. The lid 2 may be a central arm rest.

Arranged in the free end region of the lid 2 is a closing cam 3 which projects beyond the free lid end and can be moved into the closing-cam receptacle 5 against the force of a restoring spring 4.

Fastened on the storage compartment 1 or a wall of the same is a latching recess housing 6 with a latching recess 7 for receiving the closing cam 3. The latching recess housing 6 has an opening 8, through which a closing hook 9 passes. The closing hook 9 is capable (cf. FIG. 2) of latching with its free end in a latching opening 10 of the closing cam 3.

Figure 1:
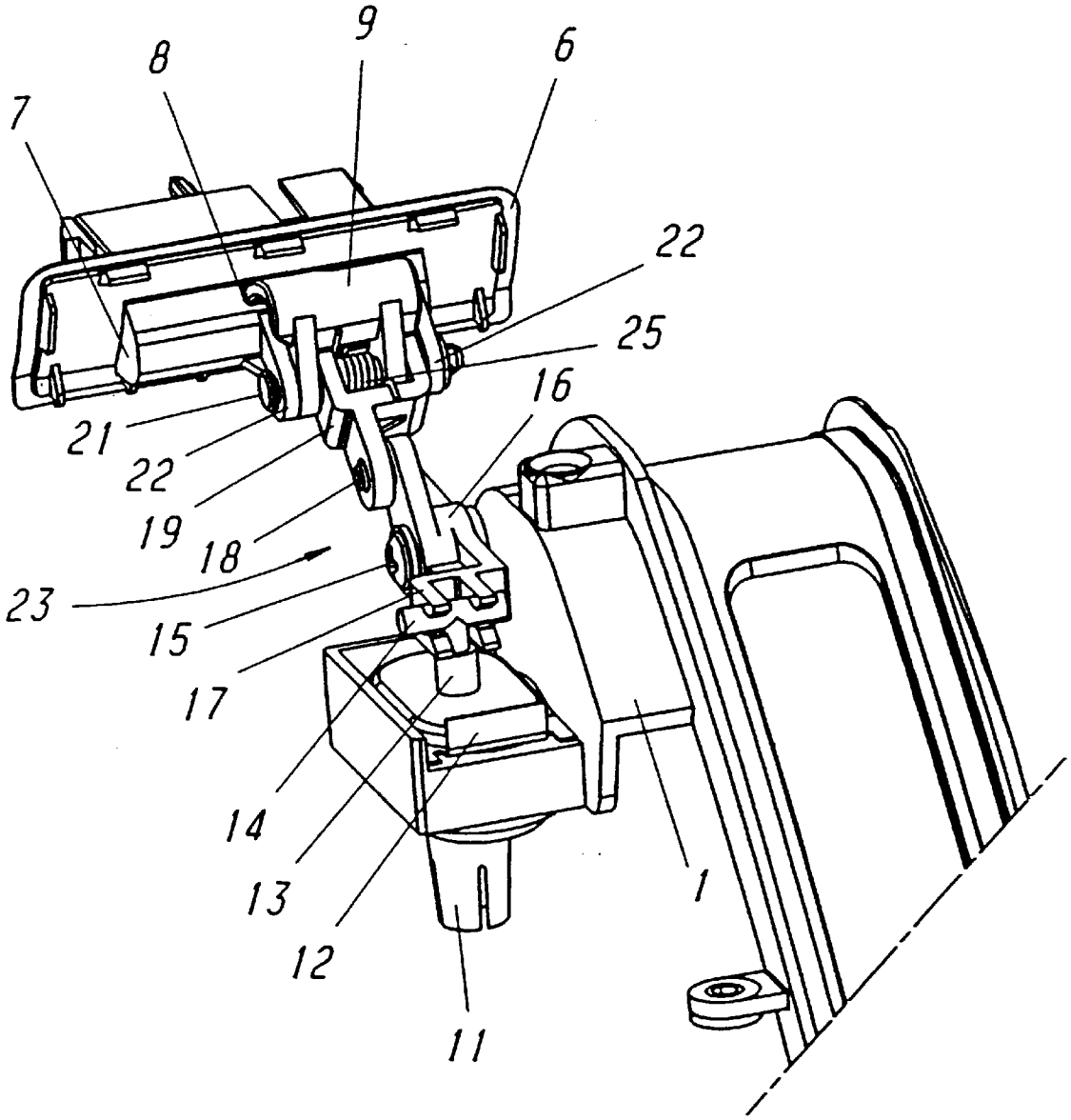
FIG. 1 shows a perspective overall view of the locking device.

Referring now to FIG. 1, arranged on the storage compartment 1, of which FIG. 1 shows only the region of a handbrake roller-action guide, are the latching recess housing 6 and a transducer element 11 for the connection to a central locking system (not shown), which may, for example, be pneumatically operated. The fastening of the transducer element 11 on the storage compartment 1 can be secured by a retaining spring 12. A piston 13 with a transverse pin 14 forms part of the transducer element 11. Also arranged on the storage compartment 1 is a pin 15 which receives an angle lever 16 in a pivotable arrangement in the elbow region. The angle lever 16 has at one end a fork-shaped bearing receptacle 17 which is connected to the transverse pin 14 by clipping on. At the other end, the angle lever 16 has a driver pin 18. A transmission lever 19 is connected to the driver pin 18 at one end, the driver pin 18 passing through a driving point, in the form of a slot 20, of the transmission lever 19. The other end of the transmission lever 19 is in the form of a two-pronged fork and the fork prongs are passed through by a bolt 21 which also bears the closing hook 9 and passes through bearing lugs 22 on the latching recess housing 6. Also located on the bolt 21 is a torsion spring 25 which loads the closing hook 9 in the closing direction. The pins 14, 15, 18, the bolt 21 and the angle lever 16 with the transmission lever 19 together form a reversing linkage 23.

FIG. 2 shows the locking device in its closed position. Opening of the locking device is carried out by means of the central locking system (not shown), on actuation of which the piston 13 is moved upwards. As a result, the angle lever 16 is pivoted about the pin 15. This pivoting movement is transmitted via the driver pin 18 to the transmission lever 19 which at the same time pivots about the bolt 21. The necessary length compensation is effected in this connection by the slot 20. So as also to guide the closing hook 9 out of the latching opening 10 in the closing cam 3 during the opening movement, a positive connection is provided in the region 24 between the transmission lever 19 and the closing hook 9.

It is to be understood that the invention is not limited to the exact construction illustrated and described above, but that various changes and modifications may be made without departing from the spirit and scope of the invention.

We claim:

1. A locking device comprising:

a closing cam spring-projected from a free end of a container lid of a storage compartment in a motor vehicle and which, when the lid is closed, engages releasably in a latching recess of a latching recess housing arranged on the storage compartment, with a transducer element which is likewise arranged on the storage compartment and can be triggered via a central locking system, with a view to locking and unlocking, and with a reversing linkage, mounted at one end on the transducer element and at the other end on the latching recess housing, for actuating a closing hook which can be pivoted into a latching opening of the closing cam.

2. The locking device according to claim 1, further comprising a restoring spring disposed wherein the closing hook can be unlocked against the force of the restoring spring.

3. The locking device according to claim 1, wherein the closing hook is connected positively to the reversing linkage in an unlocking direction.

4. The locking device according to claim 1, wherein the reversing linkage comprises an angle lever and a transmission lever, the angle lever being pivotable about a pin fixed to the storage compartment and being equipped at a first end with a pivot pin operatively connected to the transducer element and at a second end with a driver pin operatively connected to a first end of the transmission lever by a driving point made in the form of a slot, the second end region of the transmission lever being received pivotably by a bolt that also bears the closing hook.

5. A locking device comprising:

a storage compartment lid including a closing cam which is spring-projected from a free end of the lid;

a latching recess housing arranged on a storage compartment and having a latching recess, wherein the latching recess is adapted to receive the cam;

a reversing linkage having a first end operatively connected to a transducer element operable by a central locking system and a second end operatively connected to the latching recess housing; and a closing hook disposed in the latching recess to releasably engage the cam.

6. The locking device according to claim 5 wherein the closing hook is operatively connected to the second end of the reversing linkage such that when the transducer element is actuated to unlock the device, the reversing linkage pivots the closing hook out of a latching opening of the hook.

7. The locking device according to claim 5 further comprising a restoring spring positioned at the second end of the reversing linkage, the spring applying a load against the closing hook to releasably engage the cam.

8. The locking device according to claim 7 wherein the closing hook is operatively connected to the second end of the reversing linkage such that when the transducer element is actuated to lock the device, the reversing linkage applies a force to prevent the closing hook from releasing the lid.

* * * * *